United States Patent [19]

Nash

[11] 4,426,974

[45] Jan. 24, 1984

[54] DIGITAL TIMING CIRCUIT FOR A ROTATING MACHINE

[75] Inventor: Donald R. Nash, Berkey, Ohio

[73] Assignee: Allied Corporation, Morristown, N.J.

[21] Appl. No.: 353,296

[22] Filed: Mar. 1, 1982

[51] Int. Cl.[3] ..... F02P 5/04; F02P 9/00

[52] U.S. Cl. ..... 123/418; 123/417; 123/416; 123/617

[58] Field of Search ..... 123/418, 417, 612, 617, 123/414, 416, 643, 415, 644, 618, 427

[56] References Cited

U.S. PATENT DOCUMENTS

| | | | |
|---|---|---|---|
| 3,916,863 | 11/1975 | Hohne et al. | 123/617 |
| 4,324,217 | 4/1982 | Ina et al. | 123/416 |
| 4,351,307 | 9/1982 | Komurasaki et al. | 123/416 |
| 4,352,345 | 10/1982 | Menard et al. | 123/416 |
| 4,355,613 | 10/1982 | Rode et al. | 123/417 |
| 4,365,602 | 12/1982 | Stiller et al. | 123/414 |
| 4,378,778 | 4/1983 | Harter | 123/416 |

*Primary Examiner*—Raymond A. Nelli
*Attorney, Agent, or Firm*—James P. DeClercq

[57] ABSTRACT

An ignition system for a rotating internal combustion engine is provided with a digital timing circuit for determining speed-responsive ignition advance angles, responsive to a rotating armature having teeth which are unequally spaced, the unequal spaces between teeth being used to identify one particular tooth. The time required for the passage of a tooth is a measure of rotational speed, which determines advance angle. The circuit causes a dwell period to start at the leading edge of the identified tooth, computes an advance angle from previously determined rotational speed, and provides an ignition spark at an angle corresponding to the difference between the tooth angle and the actual advance angle, and stores this angle. Upon the passage of the leading edge of the next tooth, the ignition spark will occur at the stored angle.

11 Claims, 10 Drawing Figures

DIGITAL TIMING CIRCUIT FOR A ROTATING MACHINE

FIELD OF THE INVENTION

This invention relates to the production of timing signals synchronized with the rotational angle of a rotating machine, and particularly to the production of spark advance signals for triggering a spark ignition at predetermined angles of a rotating internal combustion engine and responsive to varying engine speed.

BACKGROUND OF THE INVENTION

Systems designed to produce speed-responsive signals at predetermined rotational angles of a rotating machine have generally relied upon a sensor which initiates the process, by producing a signal referenced to a rotational angle of the machine. That signal has generally been produced in response to one or more indicia regularly angularly spaced on a rotating armature, the signal being produced when an indicia was close to the sensor. The indicia has typically taken the form of mechanical protrusions on a rotating wheel, a star wheel, or indentations in a rotating wheel, each indicia causing a corresponding signal used to produce a corresponding speed responsive signal. These indicia-forming projections are conventionally referred to as teeth, from their visual similarity to gear teeth.

SUMMARY OF THE INVENTION

The rotational movement, and rotational angle of a machine is detected by means of a sensor, sensing a rotating armature to produce a signal indicative of the armature rotation.

The armature may be of any suitable form and shape when used with a suitable sensor capable of developing signals in response to the movement of the armature. Such armatures may be disks rotating about their center, with protrusions at specific rotational angles or with evenly spaced protrusions, or with indentations evenly spaced or at specific angles. The protrusions may be in the form of teeth, the edges of opposite teeth defining inter-tooth slots. Or, the armature itself may be deeply indented, as in the shape of a star wheel. The number of protrusions or teeth can be made equal to the number of trigger signals desired for a cycle of engine operation, with each tooth located at a corresponding rotational angle. In the present invention, a slot is defined by the spacing of edges of adjoining teeth, and the timed movement of a tooth through a defined rotational angle is used to determine the rotational speed of the machine. The rotational speed of the engine is determined by measuring the time between the passage of the trailing edge of one tooth and the leading edge of the following tooth. A timing count is initiated by the passage of the trailing edge of the tooth, and that count is terminated by the occurrence of the leading edge of the next or trailing tooth. The accumulated count is then indicative of the rotational speed of the machine.

In the case of an internal combustion engine, the speed can be related to an advance angle by a speed advance curve, to determine the position of a trigger signal in terms of engine rotational angle. The advance angle is then combined with the reference rotational angle, to determine the rotational angle position of the trigger signal. For example, the reference rotational angle may be the angle where a signal is produced by the leading edge of a slot or pair of teeth passing a sensor.

The advance angle may be in the form of a digital count, which is loaded into a counter register, and may either be counted down in synchronism with an internal clock from the occurrence of the reference angle signal, or a second counter register may be counted upwards until its count reaches the accumulated count, and a trigger signal generated at that time. Depending upon the degree of advance required, and the arc distance of the tooth, the trigger signal will be generated either at the occurrence of the trailing edge of the tooth, corresponding to zero degrees of advance, or some earlier time when a portion of a tooth is opposite the sensor.

According to the principals of the invention, a rotational speed of the machine may be determined during the passage of a single indicia. This indicia may be either a single tooth, or, in the preferred embodiment, may be a slot defined by edges of two adjacent teeth. Rotational speed, as determined from the single indicia, may then be used to derive a spark advance signal, to produce the trigger signal at the appropriate advance rotational angle. Of course, a plurality of reference signals may be derived from a plurality of respective indicia, each producing a respective reference signal for a trigger signal. In the case of an internal combustion engine, the reference signal angle would be a rotational angle corresponding to the angular location of a cylinder with respect to a crankshaft. Then, an advance angle signal would produce a trigger signal referenced to the reference angle appropriate to the angular location of the cylinder.

Where no advance is required, such as when an engine is being cranked for starting and is not yet running at a steady speed and is below a predetermined speed, the detection of the indicia itself could be used to produced the spark, without ignition advance.

According to a feature of the invention, once a single indicia, whether a tooth or a slot, has traveled past a sensor to allow derivation of rotational speed, that derived speed may be retained, and used for producing a trigger signal for each of the other trigger signals during an engine revolution. Or, the speed may also be computed at either shorter or longer intervals. According to the principals of the invention, the speed may be derived from a single indicia such as a tooth, or preferably by the timed passage of a slot. Then, at least two successive trigger signals may be produced without the need for recomputing the speed.

Additionally, where indicia on an armature are spaced apart by separate and distinct rotational angles, a method and means is provided for identifying the angular location of several indicia, whether teeth or slots, to derive the timing signal. This is especially important in the case of an internal combustion engine having cylinders unevenly angularly spaced from each other. Such an engine may be fitted with a rotating armature having indicia, with spacing of the indicia on the armature corresponding to the spacing of the cylinders.

Additionally, a method is provided for determining whether the sensor is operating, and whether a trigger signal is being generated, which is useful to verify the proper operation of an ignition system on an engine such as a motorcycle engine, during starting.

The method of the invention may be briefly characterized as follows:

a. Initialize a computer processor.

b. Determine whether an engine is running at a steady speed. Repeat this determination until steady speed operation is determined.
c. Identify the slot to be used for speed measurement purposes.
d. Upon detecting leading edge of the slot to be used for speed measurement, supply current to ignition coil to begin dwell, when necessary, at high speeds.
e. Upon occurrence of trailing edge of slot used for speed measurement, store a count and restart the counter.
f. Determine engine speed from the stored count, and computer count time at which to fire spark.
g. Fire the spark at the computed count time if ignition advance is required. If not required, allow trailing edge of tooth to fire spark. If ignition advance is required, prevent trailing edge of tooth from causing a spark.
h. Determine if step g spark was for the first cyclinder in a sequence, using the identification of step c. If so, prepare to provide a spark to a second cylinder using the same computed advance timing count. If not the first cylinder, prepare to remeasure speed.
i. Repeat this sequence from step d above.

These and other features and advantages of the invention will become apparent from the description of the preferred embodiment.

DESCRIPTION OF THE PREFERRED EMBODIMENT

Figure 2:
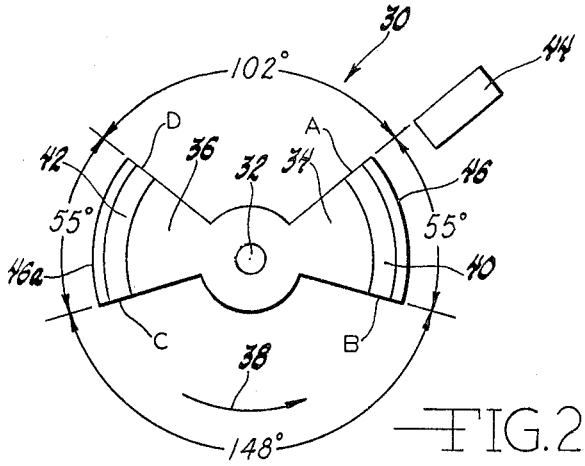
FIG. 2 shows an armature mounted for rotation past a sensor, to produce reference angle location signals.
Figure 3:
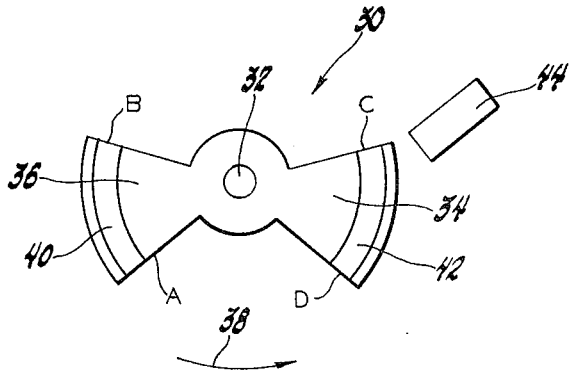
FIG. 3 shows the armature of FIG. 2 at a different rotational angle.

The preferred embodiment is described as reference to an armature rotating in synchronism with a machine, illustrated as a two cylinder internal combustion engine, such as may be used on a motorcycle. The armature has a plurality of indicia of predetermined dimension, each indicia defining a reference angle location. In the preferred embodiment, the indicia are teeth. Defined by each tooth is a slot having an angular spacing defined by the spaced apart locations of the adjacent teeth. It should be noted that the structure of the preferred embodiment can be defined as two parallel teeth defining a channel or slot therebetween, or as a single tooth pierced by a slot, or as a slot defined between a wall-like tooth and the main body of the armature, as illustrated in FIGS. 2 and 3. It should also be noted that the sensing means which detects leading and trailing edges of teeth is preferably disposed in a slot in a tooth, thus having a greater mass to sense, but may also be placed on the exterior periphery of a tooth.

Figure 1:
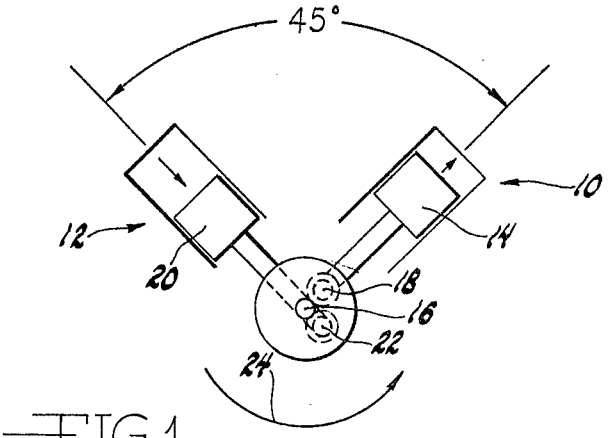
FIG. 1 is a schematic of a two cylinder engine.

In the preferred application of the invention, an internal combustion engine, such as may be used on a motorcycle, has two cylinders. As shown in FIG. 1, cylinders 10 and 12 are separated by 45°. Cylinder 10 contains a piston 14 approaching top dead center in its travel, and connected to crankshaft 16 by crank arm 18. Cylinder 12 contains a piston 20 shown moving away from top dead center towards bottom dead center, and connected to crankshaft 16 by crank arm 22, causing crankshaft 16 to rotate in direction 24. The armature shown in FIGS. 2 and 3 may be directly connected to crankshaft 16, but preferably is connected to a camshaft, not shown, which is connected by a positive drive such as gears or timing belts to crankshaft 16, so that it rotates in synchronism with the engine. FIGS. 2 and 3 show an armature 30 in two different angular positions. Armature 30 rotates in synchronism with the engine about center 32 and has teeth 34 and 36 defining four edges. The armature is shown as having a first edge A, a second edge B, a third edge C and a fourth edge D. In the preferred embodiment, tooth 34 defines an angle of 55° between edges A and B, edges B and C define an angular interval, aperture or gap of 148°, edges C and D of tooth 36 define a tooth angle of 55°, and edges D and A define an angular interval, aperture or gap of 102°. As will become further apparent below, a system according to the invention distinguishes tooth 34 from tooth 36 by sensing the difference in angular aperture between edges A and D and between edges B and C, in relation to the known direction of rotation shown by arrow 38. In the preferred embodiment, slots or channels are formed in teeth 34 and 36. A slot or channel 40 extends between edges A and B, and a slot or channel 42 extends between edges C and D. In FIG. 2, a sensor 44 is shown adjacent edge A of tooth 34. In the preferred embodiment of the invention, sensor 44 is configured so as to extend into channel 40 or 42, but neither this configuration nor the existence of channels 40 and 42 are strictly necessary to practice the invention.

FIG. 3 shows the armature 30 of FIG. 2 rotated slightly in excess of 180°, to rotate edge C to the position of edge A shown in FIG. 2.

In the case of a rotation machine such as an internal combustion engine, a trigger signal must be provided at the precise instant an ignition spark is desired. As engine speed increases, this ignition spark must be delivered in advance of the moment the piston reaches top dead center in the cylinder, to allow for the time it takes a fuel-air mixture to ignite and burn. As a consequence, an ignition spark is provided at some rotational angle in advance of piston top dead center.

Conventionally, the rotational speed of the engine is sensed, and the correct spark advance is derived from the speed in combination with a reference rotational angle location. This reference location may be correlated to a portion of the rotating armature, so that the location of a particular indicia on the armature indicates the position of a piston in its travel towards or away from top dead center. In the preferred embodiment, the reference location is given by the passage of an edge such as edge B past sensor 44, for a cylinder 10 approaching top dead center, but slightly in advance of that location and separated by several degrees such as 15 or 20 degress from the top dead center location.

As will be apparent, the advance angle signal, when combined with the reference angle signal, produces a trigger signal. The reference angle signal occurs when edge A is opposite sensor 44, producing a trigger signal a predetermined number of degrees subsequent to the position of edge A at sensor 44. This may occur, for example, where a point 46 is adjacent sensor 44. However, the location at this point 46 may vary over the radial distance of the tooth or indicia 34, depending on the rotational speed of the engine. In the case that no advance is required, a trigger signal is produced when trailing edge B is opposite sensor 44, and which may correspond to top dead center of the piston 14 in cylinder 10, or may correspond to a position either slightly before or slightly after top dead center, commonly known as base timing or idle timing. The ends of channels 40 and 42 are defined by the locaton of edges A, B, C and D, edges B and D corresponding to base or idle timing of cylinders 10 and 12, respectively. The position of edge A is defined at a rotational position which occurs sufficiently in advance of the required trigger signal at its maximum ignition advance to allow sufficient flux buildup in the primary winding of an ignition coil. This required flux buildup is known as dwell.

Correspondingly, the position of edge C is determined by the maximum ignition advance and desired dwell period. In the preferred embodiment, channels 40 and 42 are separated by 102° between edges A and D, and by 148° between edges B and C.

Figure 4:
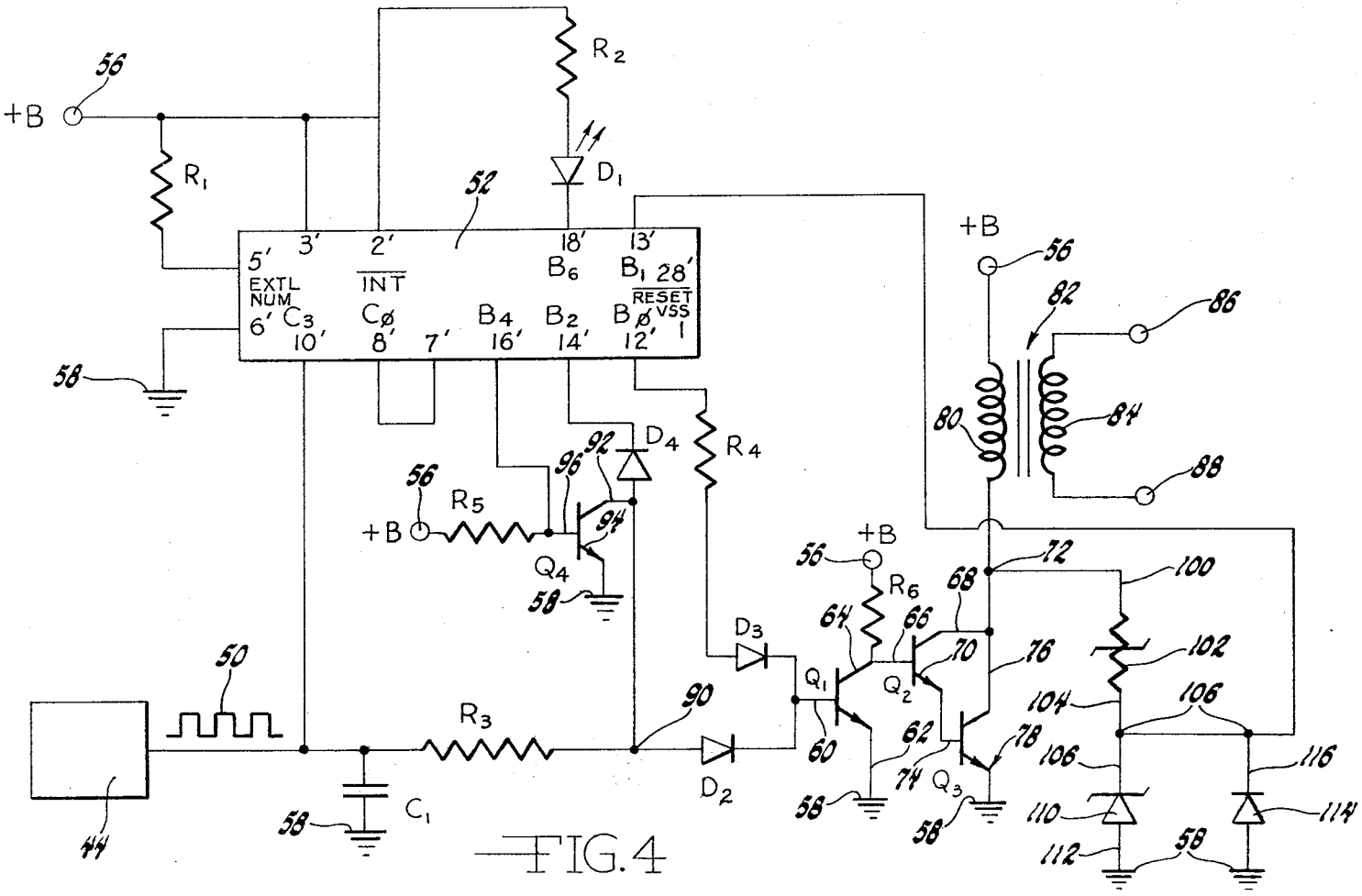
FIG. 4 is a schematic of the circuitry of the preferred embodiment.

FIG. 4 shows a system for producing the firing signal or ignition spark. The sensor 44 is shown providing an input signal 50 to a processor 52. Sensor 44, in the preferred embodiment of the invention, includes what may be characterized as a starved feedback oscillator with a sensing coil in its feedback circuit, so that its amplitude of oscillation depends on the proximity of a conductor to the sensing coil. This oscillator signal is suitably amplified and processed by a Schmitt trigger to provide input signal 50. Sensor 44 may be accomplished with accordance with the teaching of U.S. Pat. No. 3,473,110, issued to Hardin et al on Oct. 14, 1969, and others, and may also be accomplished by use of an integrated circuit available from RCA Solid State Division, Somerville, N.J., U.S.A. under part number TA6424 or TA6922. The processor 56 may be a Motorola MC6805, available from Motorola Semiconductor Products, Incorporated, 3501 Ed Bluestin Boulevard, Austin, Tex., 78721, U.S.A.

In operation, the system shown in FIGS. 1 through 4 first determines whether the engine of FIG. 1 is running at a steady speed. If its speed is below approximately 300 rpm, it may be assumed to be at an uneven cranking speed and not yet started. Therefore, no ignition advance is required. As armature 30 rotates past sensor 44, leading and trailing edges A, B, C and D will be detected. The system distinguishes tooth 44 from tooth 36 by timing, during a single revolution, the time during which an armature tooth is not adjacent sensor 44, storing this time, and comparing it with a timed count of the succeeding portion of the rotation of armature 30 where a tooth is not adjacent sensor 44. As will be apparent, engine speed cannot change quickly enough within a single revolution to invalidate this measurement. By this method, the 102° interval between edges A and D is identified, and tooth 34 is identified as the primary reference. As will be apparent, in determining which of the intervals corresponds to the 102° interval between edges A and D the speed will also be measured. This measured speed may be used to determine a desirable ignition advance. In the preferred embodiment of the invention, the speed measurement is multiplied by a proportionality constant depending on the speed to determine the proper advance angle. Once the advance angle has been determined, the same angle will be used with respect to ignition sparks initiated by all armature teeth during a single revolution.

In the illustrated embodiment, the passage of edge A past sensor 44 is detected, and delay corresponding to the desired advance is initiated. Thus, an ignition spark will be provided, for example, when a point 46 is adjacent sensor 44. If no advance is required, an ignition spark will be provided when edge B is adjacent sensor 44. Then, as rotation of armature 30 continues, edge C will pass under sensor 44, and the same delay corresponding to the desired advance will be initiated. This will result in the provision of an ignition spark at a point **46*a* which is as far from edge D as point 46 was from edge B. Then, as rotation of armature 30** continues, the 102° interval between edges A and D will serve as a basis for redetermining engine speed and proper advance, if necessary, and the sequence repeats.

In FIG. 4, a power supply B+ terminal 56 provides input power to terminal 5' of processor 52 through resistor R1, and directly to terminals 2' and 3'. Input power is also supplied to terminal 18' through resistance R2 and series diode D1. Input signal 50 from sensor 44 is applied to base 60 of transistor Q1. Capacitor C1 is provided to bypass noise signals appearing with input signal 50 to ground 58. Transistor Q1 has an emitter 62 connected to ground 58, and a collector 64 connected to base 66 of transistor Q2 and connected to power supply terminal 56 through resistor R6. Transistor Q2 has a collector 68 and an emitter 70. Collector 68 is connected to junction 72, and emitter 70 is connected to a base 74 of transistor Q3. The collector 76 of transistor Q3 is connected to junction 72, and emitter 78 is connected to ground 58. The primary 80 of an ignition coil 82 is connected between power supply terminal 56 and junction 72. The secondary winding 84 of ignition coil 82 has terminals 86 and 88 which, as will be apparent, are to be connected to a conventional spark plug, through a distributor, if desired. In the illustrated embodiment, ignition coil 82 is a double-ended coil, terminals 84 and 86 being connected to center electrodes of first and second spark plugs. As will be apparent, both such spark plugs will be fired simultaneously, one of the two simultaneous sparks having no effect, occurring on the exhaust stroke of a cylinder. The other will be effective, occurring on the compression stroke of a cylinder, at the proper advance angle.

The path just described, through resistor R3, diode D2, and transistors Q1, Q2 and Q3, is the path followed by a sensor signal to provide a trigger signal in the absence of advance. An advance trigger signal is provided by the processor 52, from terminal 12', through resistor R4 and series diode D3 to base 60 of transistor Q1.

The anode of a diode D4 is connected to the anode of diode D2 at junction 90. As will become apparent, components connected to junction 90 are for the purpose of preventing input signal 50 from directly causing trigger signals and ignition sparks when advance is desired. A subsequent, unadvanced spark would not be harmful to engine operation, but may, particularly at higher engine speeds, reduce the available dwell time, and thus reduce the strength of ignition sparks. The cathode of diode D4 is connected to terminal 14' of processor 52. A collector 92 of a transistor Q4 is also connected to junction 90 and the anode of diode D4. Emitter 94 of transistor Q4 is connected to ground 58. Base 96 is directly connected to terminal 16' of processor 52, and is also connected to power supply terminal 56 through resistor R5. As shown, a low signal appearing at terminal 14' may be used to provide increased dwell at engine speeds at which this is desirable, and a high signal appearing at terminal 16' may be used to prevent an ignition spark when the voltage applied to terminal 56 falls below a predetermined level such as a five volt level.

A first terminal 100 of a resistive device 102 known as a GMOV, a type of metal oxide varistor is connected to junction 72. Its second terminal 104 is connected to a junction 106, which is directly connected to terminal 13' of processor 52. The cathode 108 of a Zener diode 110 is connected to junction 106, the anode of diode 110 being connected to ground 58. A diode 114 also has a cathode connected to junction 106 and an anode connected to ground 58. The aforementioned devices constitute a voltage divider and transient overvoltage protection circuit, connected to a junction 72 for sensing the changes in ignition coil primary voltage and current that should result in an ignition spark, and for providing a signal indicative of an ignition spark to terminal 13' of processor 52.

The armature 30 rotates in synchronism with the machine. In the case of an internal combustion engine shown in FIG. 1, the armature rotates in synchronism with the crankshaft 16, and in the preferred embodiment is directly coupled to a conventional camshaft. As is known, the desired spark advance is a function of the rotational speed of the engine. Since the purpose of the subject invention is to derive a triggering signal related to a rotational angle, it is necessary to determine the speed of the machine.

Figure 5:
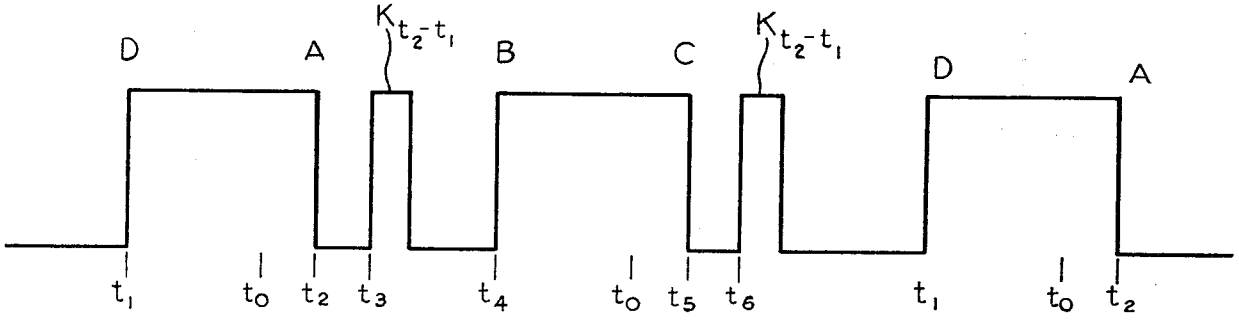
FIG. 5 is a logical timing diagram illustrating the operation of the preferred embodiment of the wave forms produced by a sensor.

The rotational speed of the machine is determined between the passage of the indicia. Referring to FIGS. 2, 3 and 5, as the armature 30 revolves in a direction shown by the arrow 38, edge D of tooth indicia 36 will pass by sensor 44, producing a high signal from sensor 44, at $t_1$. When the leading edge A of tooth 34 and slot 40 passes sensor 44, a low signal is produced, at time $t_2$. It will be apparent that the order and polarity of these high and low signals may be interchanged without affecting the principals of the invention.

The output of sensor 44 is provided to terminal 10' of processor 52. Referring to FIG. 5, during the period between times $t_1$ and $t_2$, an internal clock in processor 52 generates a series of pulses which are accumulated in a counter. This count corresponds to the period of time between the passage of trailing edge D and leading edge A, a 102° rotational angle. This angle being known, the count corresponds to the speed of the armature. The desired advance may then simply be determined by multiplying this count by a predetermined constant K. The time between times $t_2$ and $t_3$ is related to the time between $t_1$ and $t_2$ by the constant K, and represents the desired advance angle, to produce an ignition spark at time $t_3$. At time $t_4$, the sensor signal again rises, indicating the passage of the trailing edge B of tooth 34 and slot 40. This edge is, as described above, a base timing edge where an ignition spark would be produced had it not been produced earlier at time $t_3$, corresponding to a point 46 on FIG. 2, between leading edge A and trailing edge B of tooth 34's passage past sensor 44. At time $t_5$, leading edge C of tooth 36 and slot 42 pass sensor 44. The interval between times $t_5$ and $t_6$ is the calculated interval based on the interval between the passage of edges D and A, times $t_1$ and $t_2$, multiplied by the constant K, so that time $t_5$–$t_6$ is the same as time $t_2$–$t_3$, and the effective advance angle is the same, producing a trigger signal when point 46*a* is adjacent sensor 44, point 46*a* occuring at a point as far from leading edge C as point 46 was from leading edge A.

Thus, the derived speed used to produce a trigger signal at time $t_3$ is used to produce at least one subsequent trigger signal, such as at time $t_6$, before the speed is recomputed. In the preferred embodiment, one computed speed signal is used to derive two advance or trigger signals, corresponding to a full cycle of operation. As explained above, the edges B and D have an angular location related to a predetermined rotational angle of the machine. In the case of an internal combustion engine, this angular location corresponds to a point in the travel of a piston, and to an angular rotation of the crankshaft, sometime before the piston reaches top dead center. The occurrence of an edge passing the sensor generates a reference angle location signal corresponding to a rotational angle. An advance signal, representing an angular displacement, is combined with the reference angle location signal to generate a trigger signal corresponding to a further angular displacement over the armature, and to the advance angle selected for the measured speed. If no advance angle is required, then an advance signal such as $Kt_2$-$t_1$ will not be produced, and the passage of the tooth indicia edge B may be used to produce the necessary trigger signal and spark signal.

Having generally described the operation of the device, the operation will now be particularly described with reference to the circuit shown in FIG. 4, and to the flow charts shown in FIGS. 6, 6*a*, 6*b*, 6*c* and 6*d*.

Figure 6:
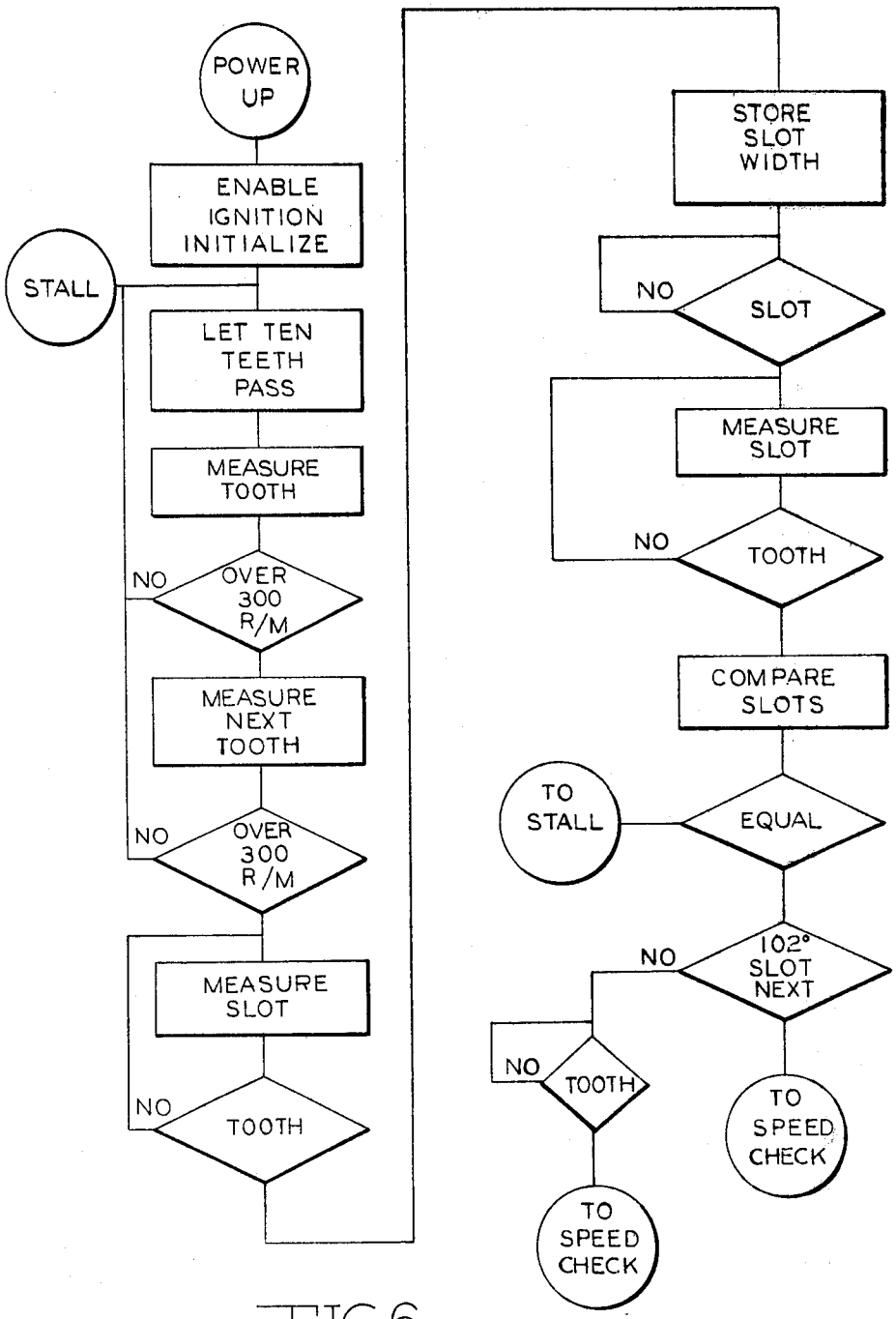
FIGS. 6, *6a*, *6b*, *6c* and *6d* constitute a flow chart of the process described with reference to FIGS. 1–5.
Figure 6A:
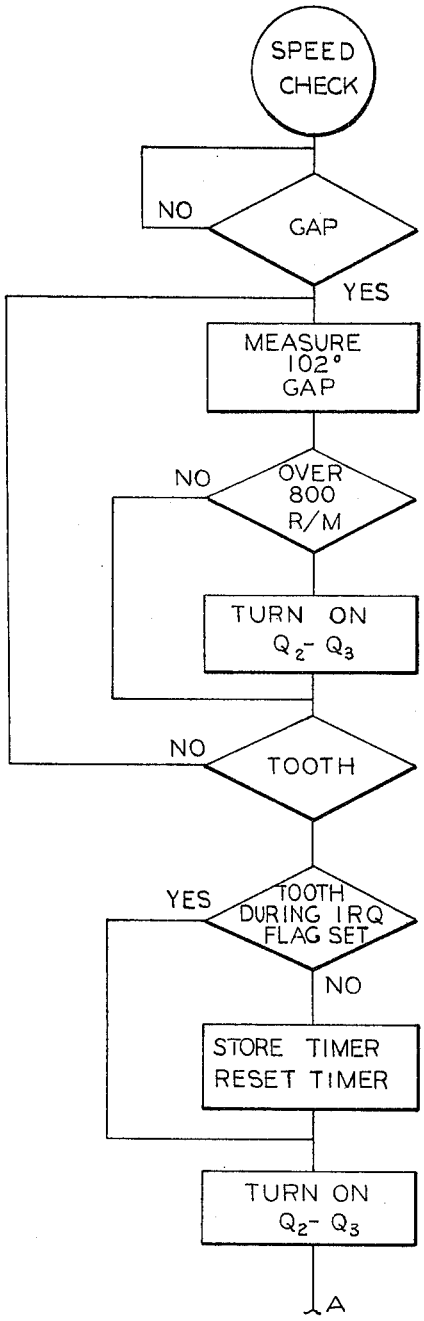
Figure 6B:
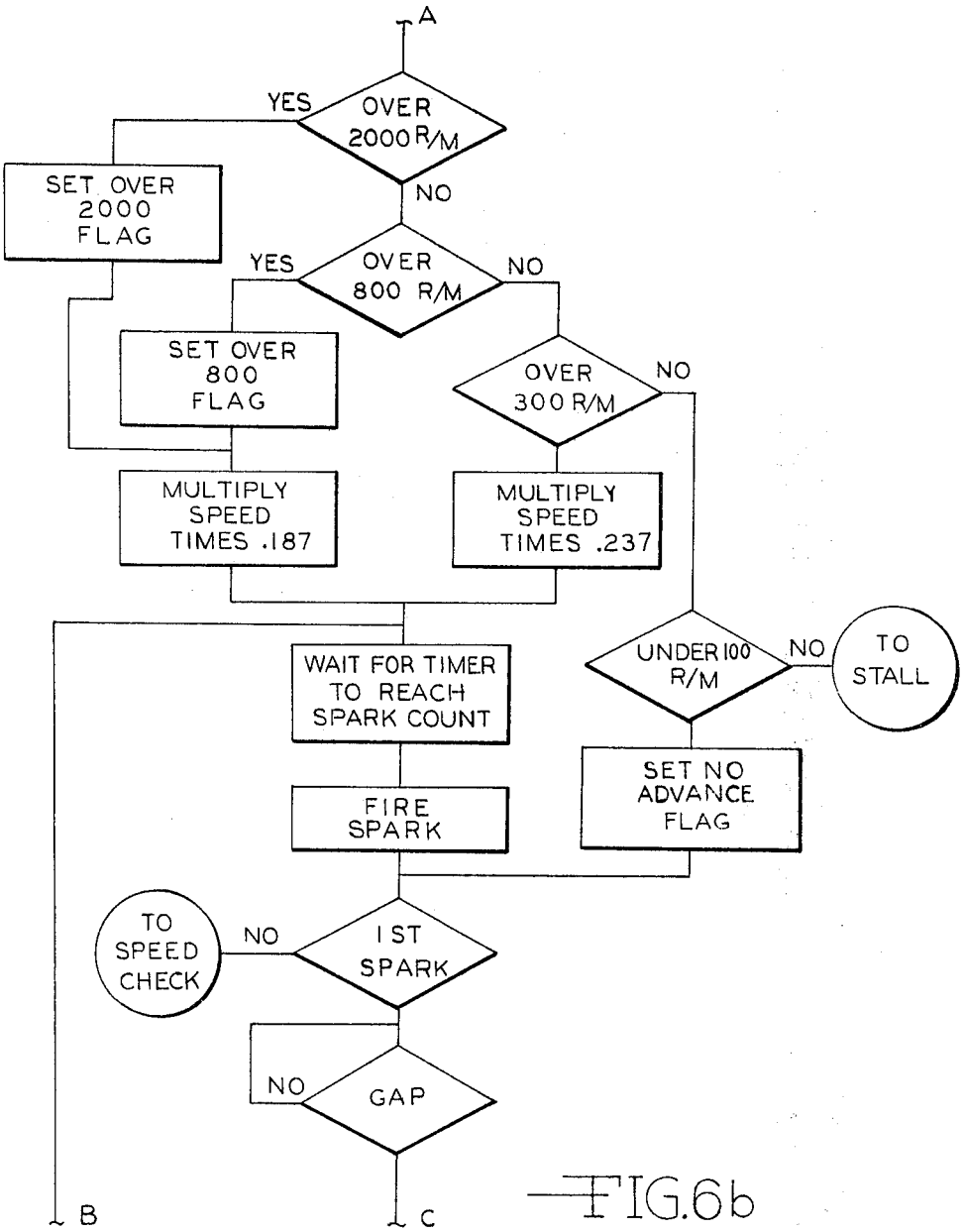
Figure 6C:
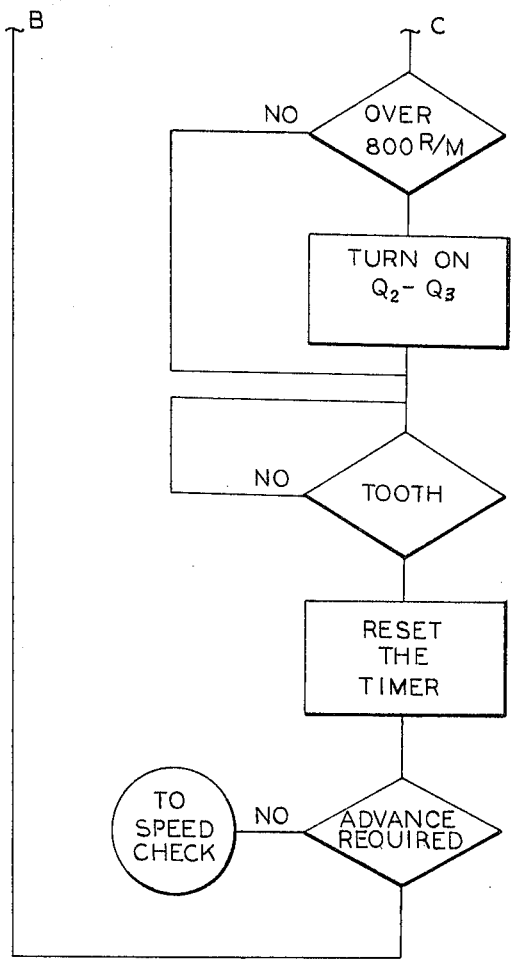
Figure 6D:
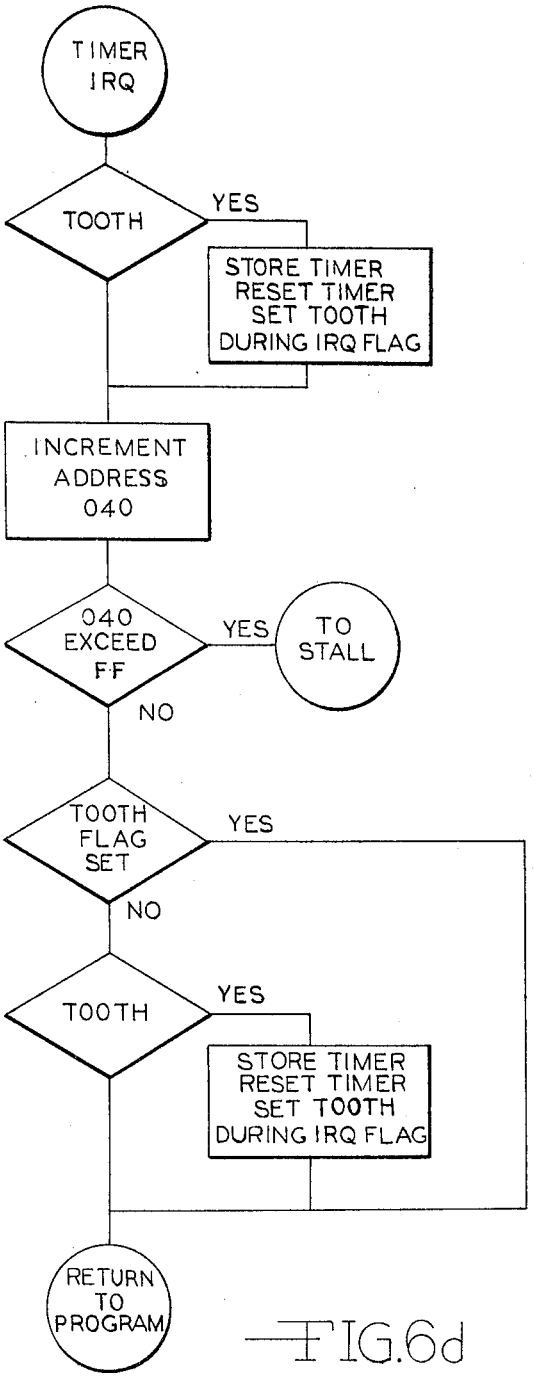

In the case of the preferred embodiment, utilizing a digital computer processor such as the Motorola MC6805, the program would be as shown in FIG. 6, and would start with an initializing routine. The program may allow ten teeth to pass, before measuring engine speed, to allow it to establish an even speed after starting, and then, as a third step, would measure the number of pulses from an internal clock during the passage of each of the slots or gaps between edges A and D and between edges B and C, for example, As the size of the tooth, and the length of the slot formed by the tooth spacing is known, the number of pulses received during the time required for edges D and A to sequentially pass sensor 44 will be determinative of engine speed. As a check routine, where the speed of the engine was not over a predetermined speed, such as 400 rpm, the program would jump back in the routine, on the assumption that the engine has not started, and would continue to measure slots until the passage of a slot indicated as speed in excess of 400 rpm, indicating that the engine was started. This routine could be repeated again, if desired.

Once the speed is determined to be above a minimum speed, then the passage of time for a slot to pass, such as the spacing between edges B and C or A and D, is measured, by the number of pulses accumulating between the passage of a trailing edge of a tooth such as D and the leading edge of a tooth such as A. The count is accumulated during the time the signal on terminal 10' remains high, indicating the presence of a slot, in a register located within the MC6805 processor. This "measure slot" routine accumulates a count in the appropriate MC6805 register until a tooth is detected. This "measure slot" routine is enabled again upon the detection of another slot as indicated by the change in the signal from sensor 44 from a low to a high value. The second slot in the direction of rotation shown would be the slot between edges B and C. As above, this second slot is measured, and a count is accumulated in an appropriate register until a successive tooth edge appears, such as edge C. The count accumulated during the passage of the slot between edges D and A is compared to the count accumulated during the passage of the slot between edges B and C. This may be done by simple subtraction. If the first count is less than the second count, the result will be negative, and the first count then represents the first slot between edges D and A. If the result were positive, the count stored during passage of the first slot would be representative of the larger slot between edges B and C. If the result of the subtraction was zero, the result would indicate an engine stall, a malfunction, or a large change in speed. Treating these conditions as a stall results in a return to the beginning of the program, and reestablishment of values. The result, where positive or negative, indicates the slot order, and which slot will appear next at the sensor, and permits the respective accumulated counts to be correlated to the selected slot widths.

In the case of slots defined by an armature, and having different spaced apart edge portions defining separate and distinct rotational angles for each respective slot, comparisons can be made of the times accumulated, or the counts accumulated for each slot, to determine at which measurement interval the selected slot appeared. Where the slots are spaced evenly around the armature and defined by an equal separation of teeth, then any slot will provide the same speed indication as any other slot, and that speed signal may be used to produce the trigger signal for other reference locations, for more or less than a full cycle of operation, as the case requires.

Once having determined the slot order and speed, the "speed check" portion of the program can then determine the speed of the armature based on the next passage of the selective slot past the sensor, and derive the proper advance signals necessary to produce the trigger signal at the correct rotational angle. As shown in FIG. 6, the "speed check" starts only when the next slot passing the sensor is the slot selected for measuring speed. In the preferred embodiment, trailing edge D should be opposite sensor 44 when the "speed check" begins.

This causes the output of sensor 44 to assume a high value, which is applied to terminal 10' of processor 52. Processor 52 then accumulates counts from its internal clock during the passage of the slot between edges D and A to measure the slot's speed during the Nth cycle.

If the speed from the previous measurement on the N-1 cycle was over a predetermined speed, then the Darlington transistor, shown as transistors Q2 and Q3, would be turned on early to insure that sufficient current is built up in the primary of ignition coil 82 before the trigger signal. If the speed of the machine measured on the previous N-1 cycle was not over this predetermined speed, this early turn-on time step is skipped, the processor 52 then waiting for the leading edge A of tooth 34 to pass sensor 44. A clock timed interrupt program called "timer IRQ", shown on FIG. *6d*, operates during the passage of a slot such as between edges D and A. An internal counter counts an oscillator signal up to a count equal to the hexadecimal value FF in a much shorter time than required for the passage of the slot between edges D and A. This count of FF interrupts the program shown on FIGS. 6 to *6a*. During the interruption, a register denominated 040 is incremented. If the armature 30 has stopped, the value accumulated in register 040 will exceed hexadecimal FF, which will be indicated as a stall, and the program will essentially begin again. As shown in FIG. *6d*, as in a typical interrupt routine, values are stored and retrieved at its beginning and end, before returning to the main program. Also, due to the time required for processing an interrupt request, checks to determine whether a tooth edge has yet passed are made at both the beginning and end of this "timer IRAQ" routine. If a tooth is sensed either at the time the "timer IRQ" routine is started, or subsequently during this routine, the accumulated count is stored, the timer is reset, and the "set tooth during IRQ" flag is established, so the count may be stored for subsequent use. The timer is then restarted. As shown in FIG. *6a*, if a tooth was detected during the "timer IRQ" routine, the Darlington transistor shown as transistors Q2 and Q3 is then turned on to build up current in primary 80. The accumulated count during passage of the slot between edges D and A pass sensor 44 will indicate a speed, which may be over 2000 rpm. Then, the speed is multiplied by a constant such as a $K=0.187$ and loaded into a register. The signal at the passage of the edge A past sensor 44 defining the slot between edges A and D is used to stop the accumulation of the count, marking the speed of the armature and then restarts the counter.

As the counter is then once again accumulating pulses from the internal clock, its accumulated count is compared to the count loaded into the register, which is a function of the count accumulated during the passage of the slot defined by edges D and A and of the constant K. When the register count is reached by the internal clock count, a trigger signal is generated which renders the Darlington transistor shown as transistors Q2 and Q3 nonconductive, causing a spark.

Then, the routine responds to a passage of a second slot, and again renders transistors Q2 and Q3, the Darlington transistor, nonconductive when the internal clock count, responsive to the leading edge of the tooth, reaches the count which was previously determined by multiplying speed by a constant and loaded into a register. This sequence repeats for at least a second slot during the rotation of armature 30, before remeasuring speed. In the preferred embodiment, the speed check is performed after every second trigger signal and its resulting ignition spark. However, as will be apparent, where a single indication is used for a plurality of successive trigger signals, suitable programming can be established to inhibit the speed check for a plurality of successive trigger signals, and until the selected speed check slot is opposite the sensor, such as the slot defined by edges A and D.

Referring again to FIGS. 4 and 5, at the moment that the Darlington transistor, shown as transistors Q2 and Q3 is de-energized, and a spark is generated by the collapse of flux in ignition coil 82, a voltage due to this collapsing field is transmitted from junction 72 to terminal 13' of processor 52. The level of this voltage is maintained between +5 volts and −0.5 volts by Zener diode 110, varible voltage responsive resistance 102 and diode 114. Terminal 18', output $B_6$ is normally low when power is initially applied, causing light emitting diode D1 to be lighted. As the sensor 44 transmits pulses when the machine is first rotated, the light emitting diode D1 is turned off. If a spark occurs, then the ringing or kickback voltage appearing at junction 72 causes the processor 52 to change the state of the signal at terminal 18'. Then, successful operation of the system would cause a spark signal at its output, and a blinking light emitting diode D1.

The light emitting diode D1 then serves as a convenient diagnostic tool, which will indicate a faulty condition in either the sensor, the system, or the engine, if an internal combustion engine which may be used with this device will not start.

If the voltage available from power supply terminal 56 falls below the operating voltage of processor 52, in this case, 5 volts, it is important that any resulting erroneous spark signal be prevented. If the output voltage is normal, terminal 16' of processor 52 will be a low voltage, preventing transistor Q4 from conducting. Thus, while output terminal 14' disables base timing when advance timing is required, when output $B_4$ to terminal 16' becomes nonconductive due to low voltage, transistor Q4 will become conductive, preventing input signal 50 from sensor 44 from causing ignition sparks.

As will be apparent, one skilled in the art may easily construct the required routines from the flow charts provided, and may make numerous modifications to the structure and method disclosed without departing from the spirit and scope of the invention.

What is claimed is:

1. A method of producing an ignition advance signal, including the steps of:

rotating an armature having a plurality of spaced-apart indicia having separate and distinct angular spacing to generate at least first and second timing signals, from at least respective first and second separate and distinct angularly spaced indicia;

identifying a selected one of said timing signals corresponding to a selected one of said indicia, and generating a trigger signal responsive to said selected one of said timing signals to provide said ignition advance signal;

said step of rotating said armature including the step of rotating an armature having a plurality of teeth and slots defined by said teeth; and said step of generating said trigger signal includes the step of sensing the passage of a first one of said slots past a defined angular position and the subsequent step of measuring the time required for a second one of said slots to pass said defined angular position to define the order of each slot passing said angular position and the order of each said timing signal.

2. The method of claim 1, wherein:

said step of generating said trigger signal includes the step of producing a reference angle signal corresponding to a predetermined portion of one said selected indicia;

producing an advanced angular displacement signal from said selected timing signal and an advance related signal to the rotational speed of said armature and producing said trigger signal in response to said advanced angular displacement signal and said reference angle signal corresponding to said armature rotating an additional angular amount past a reference angle equal to an advance angle.

3. A method of producing a trigger signal for a rotating machine, comprising the step of:

driving an armature having a plurality of spaced-apart edge pairs defining teeth and slots past a single sensor to generate at least first and second timing signals indicative of rotational speed and rotational position of said machine, and further including the steps of:

(a) identifying a selected one of said timing signals corresponding to one said edge pair;

(b) generating a trigger signal responsive to said selected timing signal; then (c) generating a second subsequent trigger signal responsive to said selected timing signal; and (d) repeating the step of identifying a selected one of said timing signals and repeating said step of generating said trigger signal and said second subsequent trigger signal responsive to said selected timing signal.

4. A system for producing a trigger signal for a rotating machine, comprising:

first means mounted for rotation with the machine and having indicia spaced apart from each other at separate and distinct angular displacements;

a single sensing means disposed adjacent said first means for sensing the passage of said indicia;

a processor connected to receive an output of said sensing means;

said sensing means producing a successive set of signals corresponding to the passage of successive indicia past said sensing means;

said processor including means for producing timing signals indicative of rotational speed from said set of signals responsive to said indicia and correlating said timing signals with respective indicia;

said processor including means for deriving an advance angle displacement signal in response to said timing signal representative of an angular displacement;

said signals produced by said sensing means being reference angle location signals;

said processor including means for combining said advance angle displacement signal with a respective reference angle location signal to produce said trigger signal at a predetermined rotational angle of said machine.

5. A system for producing a trigger signal at a preselected rotational angle of a rotating machine, comprising:

means rotating with said machine, said means having a plurality of spaced-apart indicia at separate and irregular angular spacings;

a single sensing means for producing respective signals responsive to the passage of said rotating indicia, said signals being reference angle signals indicative of reference rotational angles;

means responsive to said respective signals for producing timing signals indicative of the rotational speed of said indicia;

means for selecting one of said timing signals corresponding to a predetermined one of said indicia;

means for producing an advance angular displacement signal responsive to said selected timing signal;

means for producing an advance angular displacement signal with a respective reference angle signal to produce said trigger signal at said preselected rotational angle;

said means for selecting including a processor;

said processor including means for comparing said timing signals responsive to the passage of said irregularly-spaced indicia past said sensing means and for correlating said timing signals with respective indicia.

6. A system according to claim 5, including:

means responsive to said timing signals for computing the rotational speed of the machine and where said computing means computes said rotational speed at a maximum frequency corresponding to every second one of said trigger signals.

7. A system according to claim 5, wherein:

said means rotating with said machine is an armature;

said spaced-apart indicia being edges defining teeth and slots;

said processor including counting means for accumulating a first count responsive to the passage of two said edges defining a first slot past said sensing means and for accumulating a second count responsive to the successive passages of two said edges defining a second slot past said sensing means;

said first and second timing signals being responsive to said respective first and second counts;

said processor including means for computing the difference between said first and second accumulated counts and identifying a count responsive to a selected one of said slots as indicative of the speed of said rotating indicia;

said processor including means for counting the number of said slots being rotated past said sensor means until said selected slot is rotated past said sensing means; and means responsive to a count responsive to said selected slot for generating a new speed signal responsive to the occurrence of said selected slot and substituting said new speed signal for a previous speed signal.

8. A system according to claim 7, wherein:

said trigger signal is a spark advance signal and said rotating machine is an internal combustion engine.

9. A system according to claim 8, including:

a light emitting diode operatively connected to said processor;

said processor being responsive to the occurrence of each said trigger signal for changing the electrical impedance to said light emitting diode to be energized responsive to said occurrence of said trigger signal.

10. A system according to claim 9, wherein:

said processor includes means responsive to said set of successive signals produced by said sensing means for altering the impedance to said set of signals and causing said light emtting diode to be periodically energized and de-energized in response to the occurrence of said set of signals.

11. A system according to claim 10, wherein:

said system includes a spark coil energizing means operatively connected to and responsive to said trigger signal, and a spark coil connected to said spark coil energizing means;

said spark coil energizing means causing a spark to be produced by said spark coil in response to one said trigger signal;

said processor being operatively connected to said spark coil and responsive to said signal produced by said spark coil, and changing the impedance to said light emitting diode.

* * * * *